US010109439B2

(12) United States Patent
Komori et al.

(10) Patent No.: US 10,109,439 B2
(45) Date of Patent: Oct. 23, 2018

(54) PROTECTIVE ELEMENT

(71) Applicant: DEXERIALS CORPORATION, Tokyo (JP)

(72) Inventors: Chisato Komori, Oyama (JP); Koichi Mukai, Utsunomiya (JP); Kazutaka Furuta, Utsunomiya (JP); Toshiaki Araki, Utsunomiya (JP); Koji Ejima, Utsunomiya (JP); Takashi Fujihata, Kanazawa (JP)

(73) Assignee: DEXERIALS CORPORATION, Tokyo (JP)

( * ) Notice: Subject to any disclaimer, the term of this patent is extended or adjusted under 35 U.S.C. 154(b) by 30 days.

(21) Appl. No.: 14/779,464

(22) PCT Filed: Apr. 24, 2014

(86) PCT No.: PCT/JP2014/061566
§ 371 (c)(1),
(2) Date: Sep. 23, 2015

(87) PCT Pub. No.: WO2014/175379
PCT Pub. Date: Oct. 30, 2014

(65) Prior Publication Data

US 2016/0049272 A1 Feb. 18, 2016

(30) Foreign Application Priority Data

Apr. 25, 2013 (JP) ..... 2013-092328

(51) Int. Cl.
*H01H 37/34* (2006.01)
*H01H 37/76* (2006.01)
*H01H 85/02* (2006.01)

(52) U.S. Cl.
CPC ..... *H01H 37/34* (2013.01); *H01H 37/761* (2013.01); *H01H 2085/0283* (2013.01)

(58) Field of Classification Search
CPC ..... H01H 37/34; H01H 37/761; H01H 2085/0283; H01H 37/14; H01H 71/164;
(Continued)

(56) References Cited

U.S. PATENT DOCUMENTS 6,452,475 B1 * 9/2002 Kawazu ..... H01H 85/463 29/623
2010/0206621 A1 * 8/2010 Wada ..... H05K 1/186 174/256
(Continued)

FOREIGN PATENT DOCUMENTS

JP 2004-185960 A 7/2004
JP 2010-003665 A 1/2010
(Continued)

OTHER PUBLICATIONS

Jun. 10, 2014 International Search Report received in International Patent Application No. PCT/JP2014/061566.

*Primary Examiner* — Jerry Wu
*Assistant Examiner* — Stephen Sul
(74) *Attorney, Agent, or Firm* — Oliff PLC

(57) ABSTRACT

To spread flux evenly across the entire surface of a rectangular meltable conductor, a protective element includes: an insulating substrate; a heat-generating resistor disposed on the insulating substrate; a first and a second electrodes laminated onto the insulating substrate; a heat-generating element extracting electrode overlapping the heat-generating resistor in a state electrically insulated therefrom and electrically connected to the heat-generating resistor on a current path between the first and the second electrodes; a rectangular meltable conductor laminated between the heat-generating element extracting electrode and the first and the second electrodes for interrupting a current path between the first electrode and the second electrode by being melted by
(Continued)

heat; and a plurality of flux bodies disposed on the meltable conductor; wherein the flux bodies are disposed along the heat-generating resistor.

13 Claims, 14 Drawing Sheets

(58) Field of Classification Search
CPC ..... H01H 85/0047; H01H 85/0052; H01H 61/02; H01H 61/013; H01H 61/04
USPC ..... 337/100, 166, 183, 184, 324, 416
See application file for complete search history.

(56) References Cited

U.S. PATENT DOCUMENTS

| | | | | |
|---|---|---|---|---|
| 2011/0012704 | A1* | 1/2011 | Kimura | H01H 37/761 337/168 |
| 2012/0024491 | A1* | 2/2012 | Kinney | B22D 19/0009 164/103 |
| 2012/0249283 | A1* | 10/2012 | Kimura | H01H 37/761 337/416 |

FOREIGN PATENT DOCUMENTS

| | | | |
|---|---|---|---|
| JP | 2012-003878 | A | 1/2012 |
| JP | 2012-256569 | A | 12/2012 |

* cited by examiner

PROTECTIVE ELEMENT

TECHNICAL FIELD

The present invention relates to a protective element which interrupts a current path when an abnormality such as over-charging or over-discharging occurs. This application claims priority to Japanese Patent Application No. 2013-92328 filed on Apr. 25, 2013, the entire content of which is hereby incorporated by reference.

BACKGROUND ART

Secondary batteries are often provided to users in the form of rechargeable battery packs which can be repeatedly used. In particular, in order to protect users and electronic appliances, lithium ion secondary batteries having a high volumetric energy density typically include several protective circuits incorporated in battery packs for over-charging protection and over-discharging protection to interrupt the output of the battery pack under predetermined conditions.

Some of these protective elements use an FET switch incorporated in a battery pack to turn ON/OFF the output, for over-charging protection or over-discharging protection of the battery pack. However, even in the cases of the FET switch being short-circuited and damaged for some reason, a large current caused by a surge such as lighting momentarily flows, and an abnormally decreased output voltage or an excessively high voltage occurs in an aged battery cell, the battery pack or the electronic appliance should prevent accidents including fire, among others. For this reason, a protective element is used having a fuse which interrupts a current path in accordance with an external signal so as to safely interrupt the output of the battery cell under these possible abnormalities.

As shown in FIG. 15 (A) and FIG. 15 (B), in such a protective element 80 of a protective circuit for lithium ion secondary batteries, a meltable conductor 83 is connected between a first and second electrodes 81, 82 as a part of a current path and the meltable conductor 83 on the current path is blown by self-heating caused by an overcurrent or by a heat-generating resistor 84 provided within the protective element 80. In such a protective element 80, the molten meltable conductor 83, now in a liquid form, gathers on the first and second electrodes 81, 82 to interrupt the current path.

Additionally, in such a protective element 80 as illustrated in FIG. 15, in general, a Pb containing high melting point solder having a melting point of 300° C. or more is used as the meltable conductor 83 so that melting does not occur during mounting by reflow solder bonding. Moreover, because heating the meltable conductor 83 causes oxidation which inhibits blowout, a flux body 85 is laminated thereon in order to remove oxide film generated on the meltable conductor 83 and improve wettability of the meltable conductor 83.

PRIOR ART LITERATURE

Patent Literatures

PLT 1: Japanese Unexamined Patent Application Publication No. 2010-003665

PLT 2: Japanese Unexamined Patent Application Publication No. 2004-185960

PLT 3: Japanese Unexamined Patent Application Publication No. 2012-003878

SUMMARY OF THE INVENTION

Problem to be Solved by the Invention

Along with increases in capacity and output in lithium ion secondary batteries in recent years, improved ratings are also desired in a protective element 80 of a protective circuit for lithium ion secondary batteries. In addition, along with miniaturization and slimming of electronic appliances, the protective element 80 is also desired to be smaller and thinner.

In order to improve ratings and allow larger currents, it is desirable to reduce the conductor resistance of the meltable conductor 83. The resistance of the meltable conductor 83 can be reduced by (1) increasing conductor cross-sectional area or (2) reducing the conductor length between the first and second electrodes 81, 82 between which the meltable conductor 83 is arranged. In addition, because contact resistance between the meltable conductor 83 and the first and second electrodes 81, 82 also affects the rating of the protective element 80, (3) increasing contact area between the meltable conductor 83 and first and second electrodes 81, 82 is also effective.

Because the protective element 80 is desired to be smaller and thinner, (1) increasing conductor cross-sectional area has a limit; therefore, effective solutions for improving ratings are (2) decreasing the conductor length and (3) increasing the contact area between the meltable conductor 83 and the first and second electrodes 81, 82. For this reason, the shape of the meltable conductor 83, as shown in FIG. 16, defines a rectangle in which an electrode distance D1 between the first and second electrodes 81, 82, is short, and a connection distance D2 along which the conductor contacts the first and second electrodes 81, 82, is long.

Furthermore, a flux body 85 is provided above the meltable conductor 83 to prevent oxidation and improve wettability and is desirably held in an elliptical shape in accordance with the shape of the meltable conductor 83. However, in an elliptically shaped flux body, tension is stronger on both ends of the major axis leading to a tendency to deviate towards one end of the major axis with even a small inclination; the elliptically shaped flux body is thus held deviating from the center of the heat-generating resistor 84 and consequently does not spread across the entire meltable conductor 83 thereby adversely increasing melting time.

Therefore, the flux body provided on the meltable conductor 83 is preferably held in a circular shape in view of holding the flux body on the center of the heat-generating resistor 84. However, in the meltable conductor 83 which has a rectangular shape in order to improve ratings, the diameter of such a circular flux body is determined by the length of the short dimension of the meltable conductor 83, leading to held amount being insufficient to cover the entire surface area of the meltable conductor 83, thus precluding improvements in oxidation resistance and wettability.

Therefore, an object of the present invention is to provide a protective element in which flux can be spread evenly to the entire surface of the meltable conductor even in the case of a rectangular meltable conductor.

Solution to Problem

To solve the aforementioned problem, a protective element according to the present invention includes: an insulating substrate; a heat-generating resistor disposed on the insulating substrate; a first and a second electrodes laminated onto the insulating substrate; a heat-generating element extracting electrode overlapping the heat-generating resistor in a state electrically insulated therefrom and electrically connected to the heat-generating resistor on a current path between the first and the second electrodes; a rectangular meltable conductor laminated between the heat-generating element extracting electrode and the first and second electrodes for interrupting a current path between the first electrode and the second electrodes by being melted by heat; and a plurality of flux bodies disposed on the meltable conductor; wherein the plurality of flux bodies are disposed along the heat-generating resistor.

Advantageous Effects of Invention

According to the present invention, because a plurality of flux bodies are provided along the heat-generating resistor, the plurality of flux bodies can cover a wide area of the surface of the rectangular meltable conductor, and heat generated by the heat-generating resistor can spread flux evenly across the entire surface of the meltable conductor. Accordingly, a protective element according to the present invention suppresses oxidation and improves wettability in the meltable conductor thus enabling rapid interruption of a current path between the first and second electrodes.

DESCRIPTION OF EMBODIMENTS

Figure 1A:
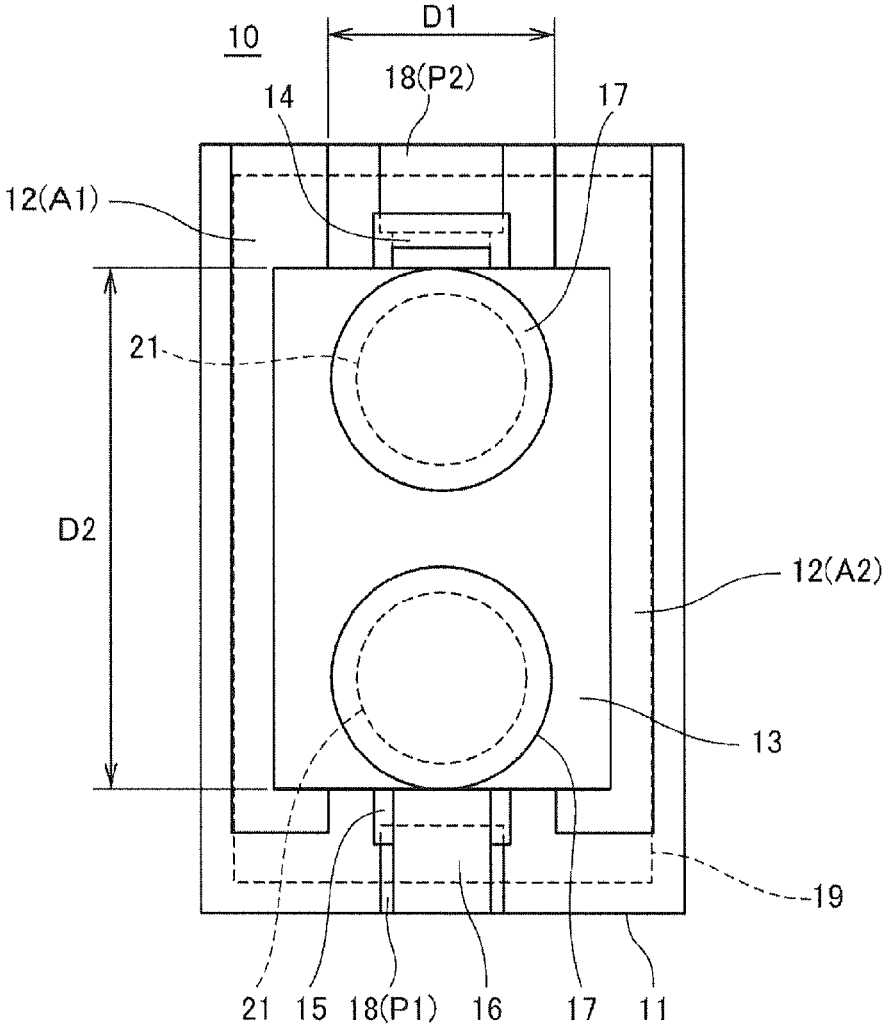
FIG. 1 (A) illustrates a protective element according to an embodiment of the present invention in a plan view in which a covering member is illustrated as being transparent and FIG. 1 (B) illustrates a cross-sectional view thereof.

Embodiments of protective element according to the present invention will now be more particularly described with reference to the accompanying drawings. It should be noted that the present invention is not limited to the embodiments described below and various modifications can be added to the embodiment without departing from the scope of the present invention. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

Protective Element Configuration

Figure 1B:
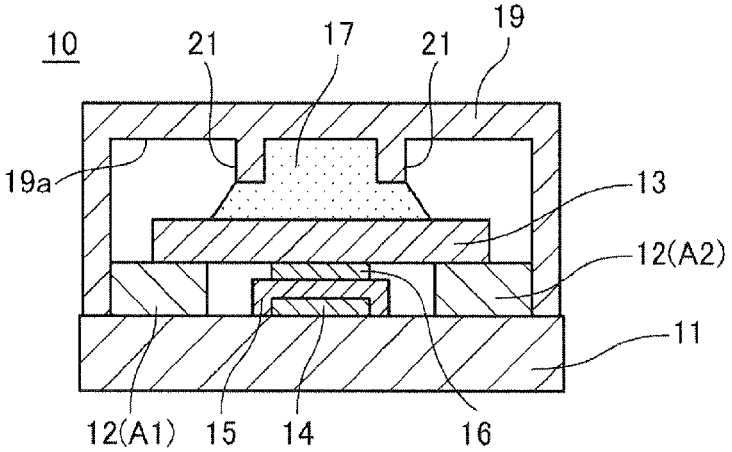

As illustrated in FIGS. 1 (A) and (B), a protective element 10 according to the present invention includes: an insulating substrate 11; a heat-generating resistor 14 disposed on the insulating substrate 11 and covered by an insulating member 15; a first and the second electrodes 12 (A1), 12 (A2) formed on both edges of the insulating substrate 11; a heat-generating element extracting electrode 16 laminated above the insulating member 15 so as to overlap the heat-generating resistor 14; a meltable conductor 13 having both ends respectively connected to the electrodes 12 (A1), 12 (A2) and the central portion of which is connected to the heat generating element extracting electrode 16; and a plurality of flux bodies 17 arranged on the meltable conductor 13 to remove an oxidation film generated on the meltable conductor 13 and to improve wettability of the meltable conductor 13.

The insulating substrate 11 is formed in an approximately rectangular shape by using an insulating material such as alumina, glass ceramics, mullite and zirconia. Other materials used for printed circuit boards such as glass epoxy substrate or phenol substrate may be used as the insulating substrate 11; in these cases, however, the temperature at which the fuses are blown should be considered.

The heat-generating resistor 14 is made of a conductive material such as W, Mo and Ru, having a relatively high resistance and generates a heat when a current flows therethrough. A powdered alloy, composition or compound of these materials is mixed with a resin binder to obtain a paste, which is screen-printed as a pattern on the insulating substrate 11 and baked to form the heat-generating resistor 14.

The insulating member 15 is arranged such that it covers the heat-generating resistor 14, and the heat-generating element extracting electrode 16 is arranged to face the heat-generating resistor 14 with the insulating member 15 interposing therebetween. The insulating member 15 may be laminated between the heat-generating resistor 14 and the insulating substrate 11 in order to efficiently conduct the heat of the heat-generating resistor 14 to the meltable conductor 13. A glass, for example, can be used as the insulating member 15.

The heat-generating element extracting electrode 16 is continuous with one end of the heat-generating resistor 14 and one end is connected to the heat-generating element extracting electrode 18 (P1) and the other end is connected to the heat-generating element extracting electrode 18 (P2) via the heat-generating resistor 14.

The meltable conductor 13 is formed from a low melting point metal, such as a Pb free solder having Sn as a primary constituent, capable of being promptly melted by the heat of the heat-generating resistor 14. In addition, the meltable conductor 13 may be formed by using a high melting point metal including In, Pb, Ag and/or Cu alloys or may have a laminated structure of a low melting point metal and a high melting point metal of Ag, Cu or an alloy consisting essentially of these.

It should be noted that the meltable conductor 13 is connected to the heat-generating element extracting electrode 16 and the electrodes 12 (A1), 12 (A2) by, for example, soldering. The meltable conductor 13 can be easily connected by reflow solder bonding.

For internal protection, the protective element 10 may include a covering member 19 disposed on the insulating substrate 11.

In the protective element 10, the meltable conductor 13 overlaps the heat-generating resistor 14, with the insulating member 15 and the heat-generating element extracting electrode 16 interposing therebetween, enabling efficient conveyance of heat generated by the heat-generating resistor 14 to the meltable conductor 13 which facilitates rapid blowout.

In order to improve ratings and allow larger currents in the protective element 10, reductions are desired in conductor resistance of the meltable conductor 13. Therefore, in the protective element 10, it is possible to reduce conductor length of the electrodes 12 (A1), (A2) and increase connection surface area between the meltable conductor 13 and the electrodes (A1), (A2); as shown in the plan view of FIG. 1 (A), the shape of the meltable conductor 13 forms a rectangle in which the electrode distance D1 of the electrodes 12 (A1), (A2) is short and the connection distance D2 of the electrodes (A1), (A2) is long.

In addition, with the meltable conductor 13 being rectangular, the heat-generating resistor 14, the insulating member 15 and the heat-generating element extracting electrode 16 are also accordingly short between the electrodes 12 (A1), (A2) and long along the long edge of the electrodes (A1), (A2) thus also forming a rectangle.

Positioning of the Flux Bodies 17

A plurality of flux bodies 17 are provided on the surface of the meltable conductor 13. Each of the flux bodies is approximately circular and tension acts evenly throughout the entirety of each thereof so that holding is well balanced and without lateral bias.

Furthermore, the plurality of flux bodies 17 are arranged along the heat-generating resistor 14. Thus, in the protective element 10, the plurality of flux bodies can widely cover the surface of the rectangular meltable conductor 13, and heat generated by the heat-generating resistor 14 causes the flux bodies 17 to spread evenly across the entire surface of the meltable conductor 13. Consequently, by preventing oxidation and improving wettability of the meltable conductor 13, the current path between the electrodes 12 (A1), (A2) can be rapidly blown in the protective element 10.

For example, the plurality of flux bodies 17 are, as illustrated in FIG. 1 (A), arranged along the heat-generating resister 14 on the surface of the meltable conductor 13 in a position overlapping the heat-generating resistor 14. Heat from heat-generating resistor 14 can thus cause the plurality of flux bodies 17 to spread evenly throughout the entire surface of the meltable conductor 13 from the position of overlap of the meltable conductor 13 with the heat-generating resistor 14 to peripheral edges and the meltable conductor 13 can thereby be quickly blown.

Figure 2:
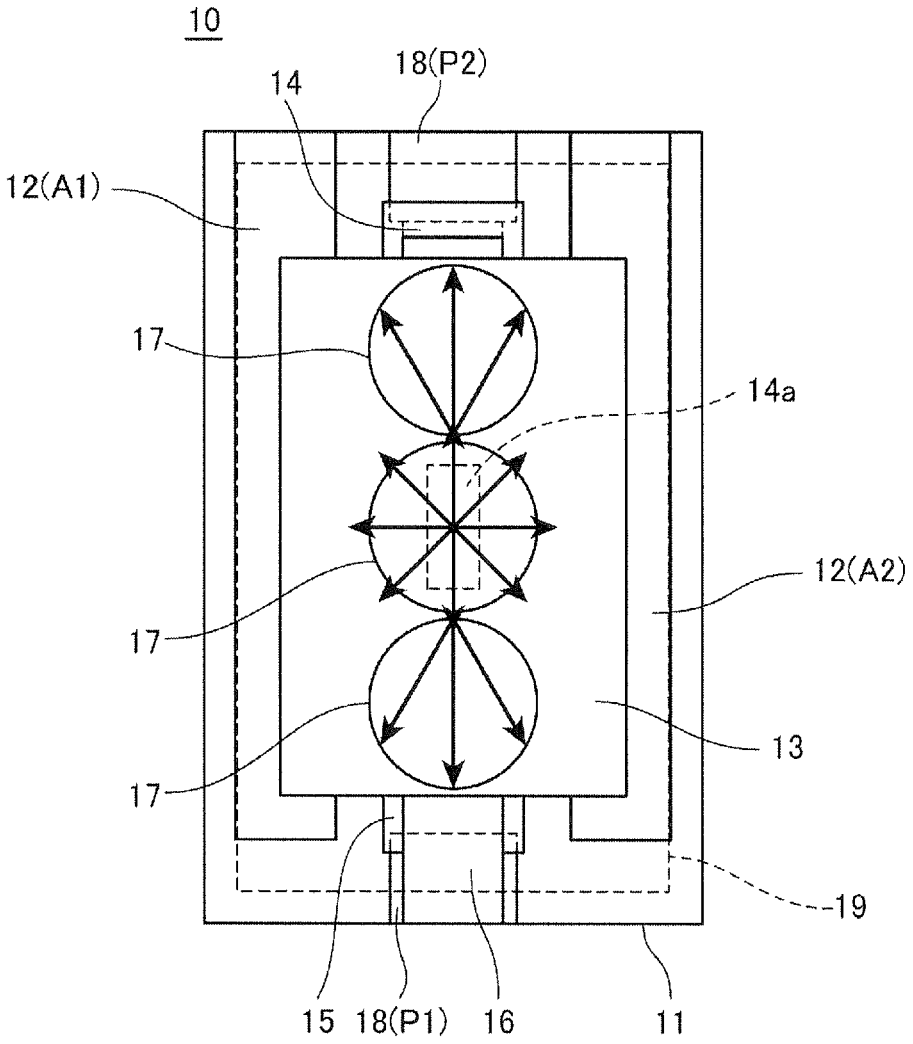
FIG. 2 is a plan view illustrating a protective element in which flux is arranged on a heat-generation center of a heat-generating resistor in which a covering member is illustrated as being transparent.

As shown in FIG. 2, at least one flux body 17 is preferably positioned on a heat-generation center 14*a* of the heat-generating resistor 14. The heat-generation center 14*a* of the heat-generating resistor 14 refers to a central portion of the rectangular heat-generating resistor 14 provided on the insulating substrate 11. In the heat-generating resistor 14, because peripheral portions leak heat to the surroundings, the heat-generation center 14*a*, being farthest from the peripheral portions, has the highest temperature, and the heat-generating resistor 14 has a temperature distribution in which temperature gradually decreases towards peripheral portions.

In the protective element 10, by arranging the flux bodies 17 on the heat-generation center 14*a*, the flux bodies 17 spread radially from the heat-generation center 14*a* towards peripheral portions in accordance with the heat distribution of the heat-generating resistor 14. In the case of not providing the flux bodies 17 on the heat-generation center 14*a*, it is difficult to spread the flux bodies 17 towards the heat-generation center 14*a*, which has the highest temperature, and the flux bodies 17 might not spread to the vicinity above the heat-generation center 14*a*.

Therefore, in the protective element 10, by providing the flux bodies 17 on this difficult to reach area of the heat-generation center 14*a* of the heat-generating resistor 14, spreading of the flux bodies 17 to the entire surface of the meltable conductor 13 can be assured.

Melting Portions

Figure 3:
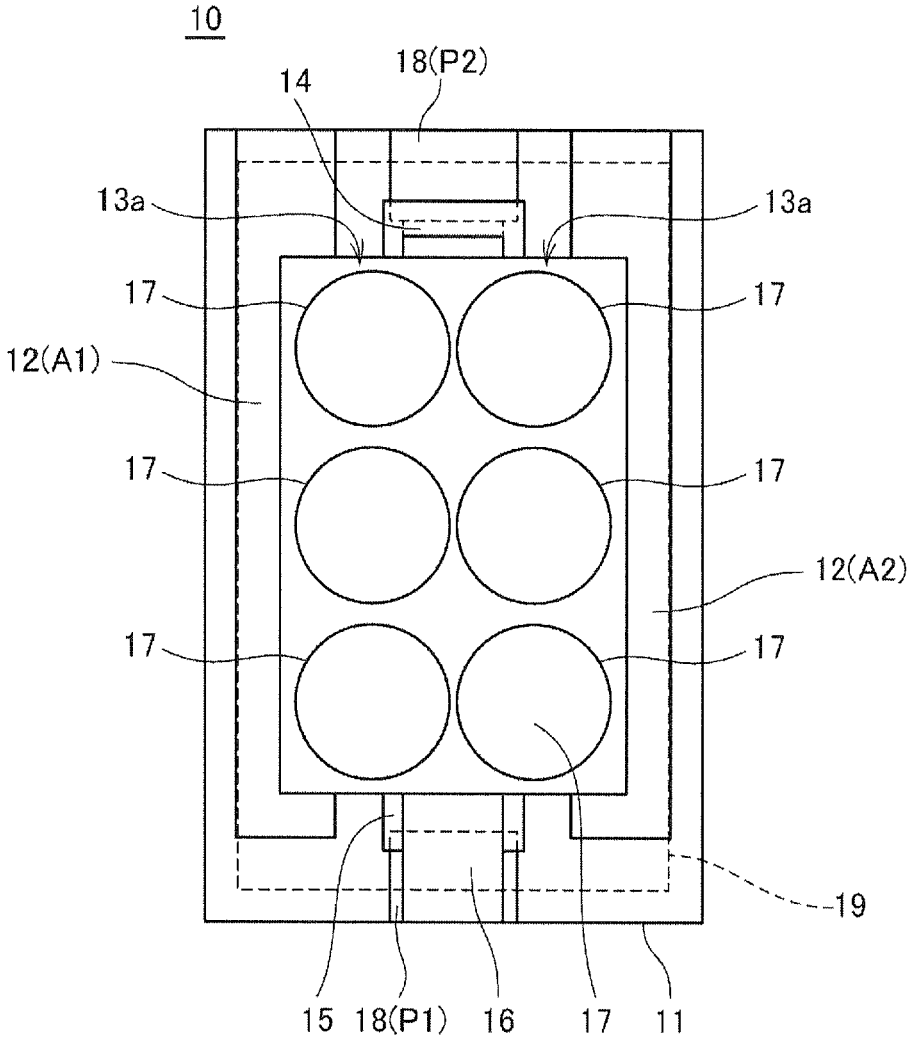
FIG. 3 is a plan view illustrating a protective element in which flux is arranged on melting portions of a meltable conductor in which a covering member is illustrated as being transparent.

The plurality of the flux bodies 17, as illustrated in FIG. 3, may be arranged on the melting portions 13*a* on the surface of the meltable conductor 13 between the heat-generating element extracting electrode 16 and the electrodes (A1), (A2) in alignment with the heat-generating resistor 14. The meltable conductor 13 is connected between the heat-generating element extracting electrode 16 and the electrodes 12 (A1), 12 (A2) and is melted by self-generated heat caused by an overcurrent (Joule heat) or heat generated by the heat generating resistor 14 thus causing blowout between the heat-generating element extracting electrode 16 and electrodes 12 (A1), 12 (A2). In this manner, the protective element 10 interrupts the current path. The melting portions 13*a* of the meltable conductor 13, as illustrated in FIG. 3, refer to melting locations of the meltable conductor 13, which is connected between the heat-generating element extracting electrode 16 and the electrodes 12 (A1), 12 (A2); these locations, in particular, are regions between the heat-generating element extracting electrode 16 and the electrode 12 (A1) and between the heat-generating element extracting electrode 16 and the electrode 12 (A2).

In the protective element 10, aligning the flux bodies along the heat-generating resistor 14 on the melting portions 13*a* of the meltable conductor 13 prevents oxidation of the meltable conductor 13, which is between the heat-generating element extracting electrode 16 and the electrodes 12 (A1), 12 (A2), and enables rapid blowout of the melting portions 13*a* which interrupts the current path between the electrodes 12 (A1), 12 (A2).

Figure 4A:
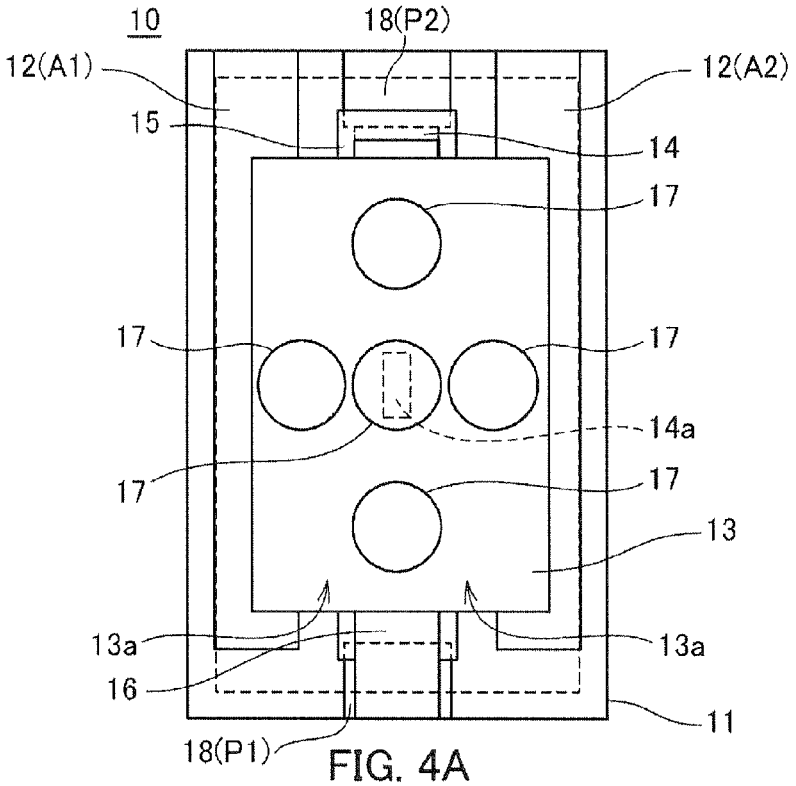
FIGS. 4 (A) and (B) are plan views respectively illustrating one example of a protective element in which flux is arranged on a heat-generation center of a heat-generating resistor and melting portions of a meltable conductor in which a covering member is illustrated as being transparent.
Figure 4B:
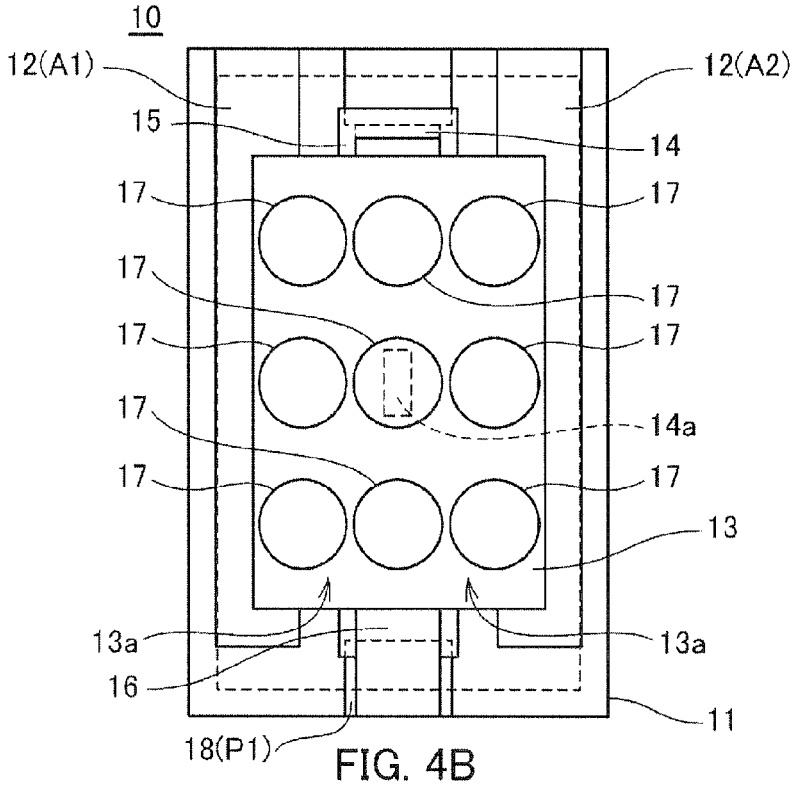
Figure 5:
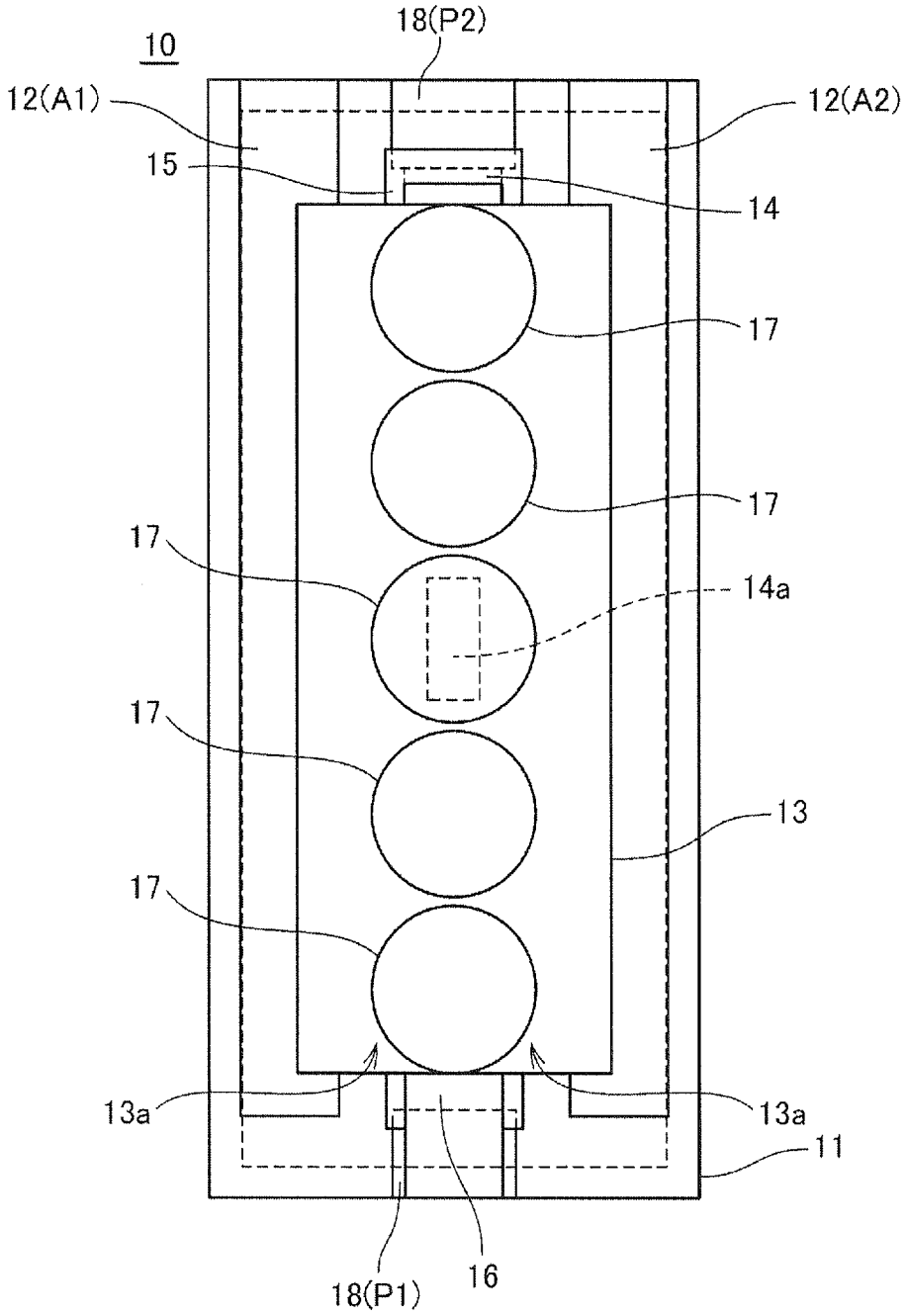
FIG. 5 is a plan view illustrating a protective element in which flux is arranged on a heat-generation center of a heat-generating resistor and has a large diameter covering melting portions of a meltable conductor in which a covering member is illustrated as being transparent.

In addition, the plurality of flux bodies 17, as illustrated in FIGS. 4 (A) and (B), may be arranged along the heat-generating resistor 14 above the heat-generation center 14*a* of the heat-generating resistor 14 and on the melting portions 13*a* of the meltable conductor 13. In addition, as illustrated in FIG. 5, the plurality of flux bodies 17 of a size sufficient to cover the melting portions 13*a* of the meltable conductor 13 may be positioned along the heat-generating resistor 14 on positions overlapping the heat-generating resistor 14. Furthermore, as illustrated in FIGS. 4 and 5, in any of these cases, at least one of the flux bodies 17 is preferably provided above the heat-generation center 14*a* of the heat-generating resistor 14 in the protective element 10.

Each of the flux bodies 17 spreads radially toward peripheral portions from the heat-generation center 14*a*, which has the highest temperature and is the most difficult location for spreading to reach, ensuring that the flux bodies 17 can spread to the entire surface of the meltable conductor 13. Furthermore, reliable blowout is required in the melting portions 13*a* of the meltable conductor 13, which is arranged between the heat-generating element extracting electrode 16 and the electrodes 12 (A1), 12 (A2), and oxidation thereof is suppressed by the flux bodies 17 thus enabling rapid blowout.

Symmetric Arrangement

Furthermore, the plurality of flux bodies 17 are preferably arranged symmetrically about the heat-generation center 14*a* of the heat-generating resistor 14. The flux bodies 17 can thus spread evenly across the entire surface of the meltable conductor 13 preventing variances in blowout properties among individual products and enabling reliable and rapid blowout.

Figure 6:
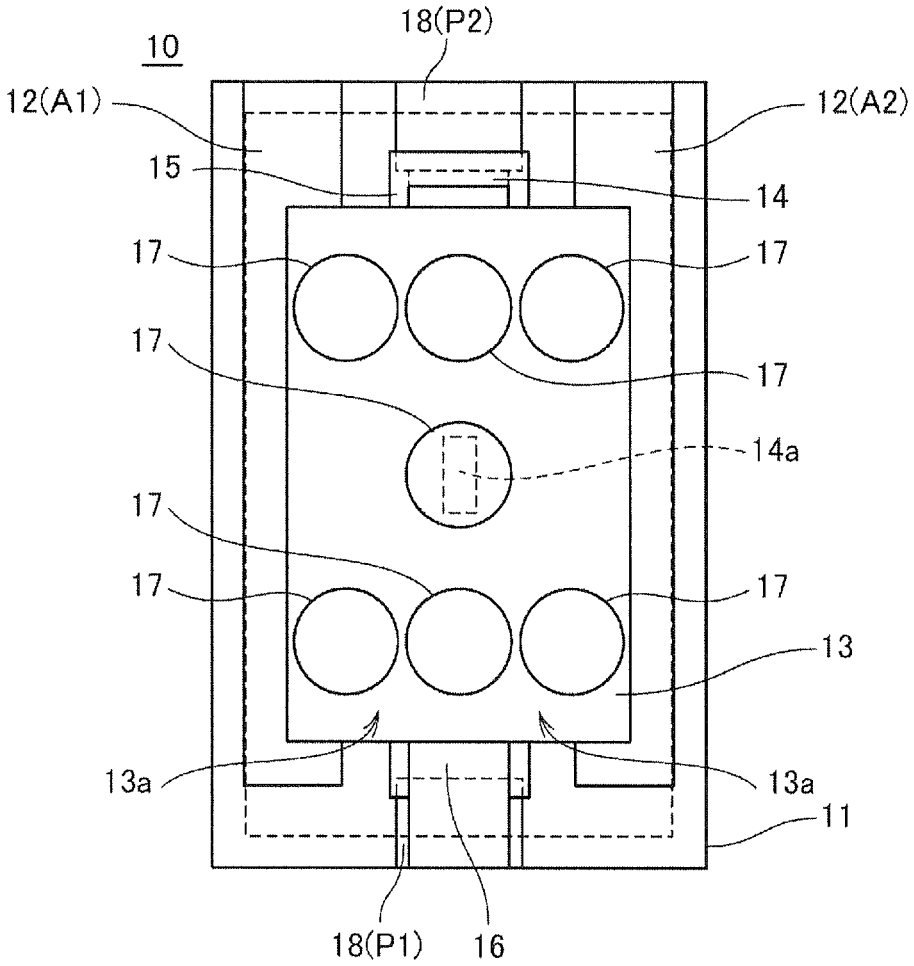
FIG. 6 is a plan view illustrating a protective element in which flux bodies are arranged symmetrically in which a covering member is illustrated as being transparent.
Figure 7:
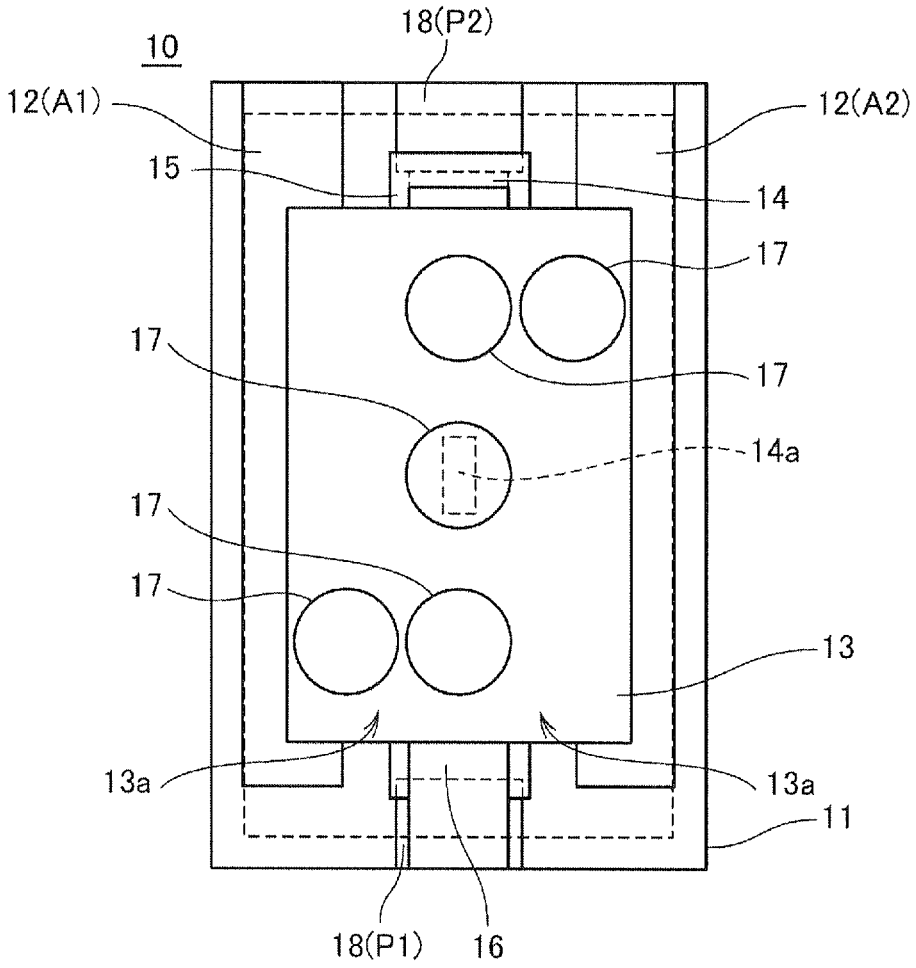
FIG. 7 is a plan view illustrating a protective element in which flux bodies are arranged symmetrically in which a covering member is illustrated as being transparent.

As illustrated in FIG. 6, the plurality of flux bodies 17 may be arranged to have bilateral symmetry about the heat-generation center 14*a* of the heat-generating resistor 14 and, as illustrated in FIG. 7, may also be arranged to have point symmetry. In this case, one of the plurality of flux bodies 17 is arranged on the heat-generation center 14*a* of the heat-generating resistor 14 and the others are arranged symmetrically about the heat-generation center 14*a;* accordingly, the plurality of flux bodies 17 are, in this case, odd in number.

Figure 8:
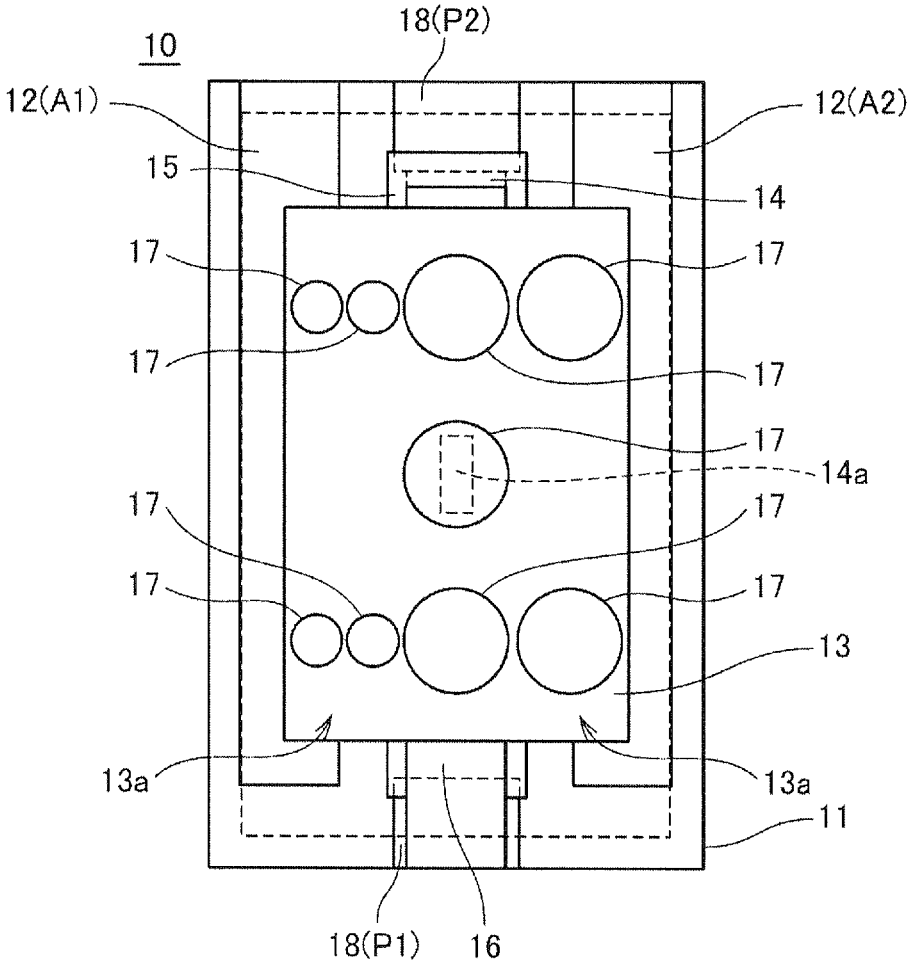
FIG. 8 is a plan view illustrating a protective element in which flux bodies are arranged asymmetrically in which a covering member is illustrated as being transparent.

It should be noted that the plurality of flux bodies 17 may be arranged asymmetrically in relation to the heat-generation center 14*a* of the heat-generating resistor 14. In this case, as illustrated in FIG. 8, in addition to arranging one of the plurality of flux bodies 17 on the heat-generation center 14*a* of the heat-generating resistor 14, flux bodies 17 of varying sizes are arranged on left and right sides and total volume of the flux bodies 17 on left and right sides is preferably equalized. By evenly distributing the total volume of the flux bodies 17 symmetrically about the heat-generation center 14*a*, as in the case of symmetrical arrangement, the flux bodies 17 can be made to spread evenly across the entire surface of the meltable conductor 13.

Holding Mechanism

The protective element 10 includes a holding mechanism to hold the flux bodies 17 at predetermined positions on the above-mentioned meltable conductor 13. The holding mechanism, for example as illustrated in FIGS. 1 (A) and (B), can be formed by providing a rib 21 on a top surface 19 of a covering member 19. The rib 21, comprises, for example, a circular side wall, and is arranged so as to protrude into the interior of the protective element 10 from the top surface 19*a* of the covering member 19. The plurality of flux bodies 17 are held between the rib 21 and the surface of the meltable conductor 13 by tension provided by the rib 21. One rib 21 is provided for each of the flux bodies l 7, and a plurality of the ribs 21 are formed in positions corresponding to each of the above-mentioned plurality of flux bodies 17.

Furthermore, as the diameter of the flux bodies 17 are determined by the diameter of the rib 21, the rib 21 has a size according to the size of each of the flux bodies 17. Still further, in the rib 21, a slit in the height direction may be formed on a portion of a side wall.

Figure 9:
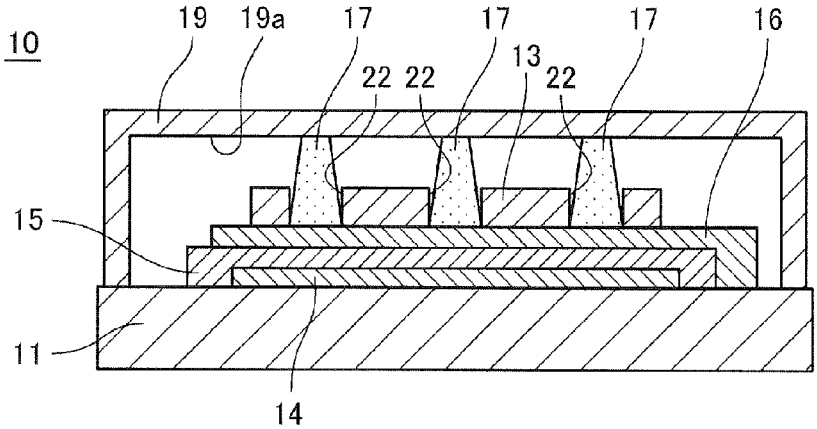
FIG. 9 is a cross-sectional view of a protective element having a holding hole provided on a meltable conductor as a flux holding mechanism.

Additionally, in the protective element 10, as illustrated in FIG. 9, holding holes 22 may be formed on the surface of the meltable conductor 13 as the holding mechanism. The flux bodies 17 are held at predetermined positions on the meltable conductor 13 by being filled into the holding holes 22. The holding holes 22 may be formed concurrently with forming the meltable conductor 13 by pressing, for example, and the holding holes 22 may be penetrating holes which completely penetrate the meltable conductor 13 or may be non-penetrating concaves formed on the surface of the meltable conductor 13. One holding hole 22 is provided for each of the flux bodies 17, and a plurality of the holes 22 are formed in positions corresponding to each of the above-mentioned plurality of flux bodies 17.

Openings of the holding holes 22 on the surface of the meltable conductor 13 are preferably circular in order to hold the flux bodies 17 in a well-balanced manner.

Furthermore, as the diameter of the flux bodies 17 are determined by the diameter of the holding holes 22, the holding holes 22 have a size according to the size of each of the flux bodies 17.

Figure 10:
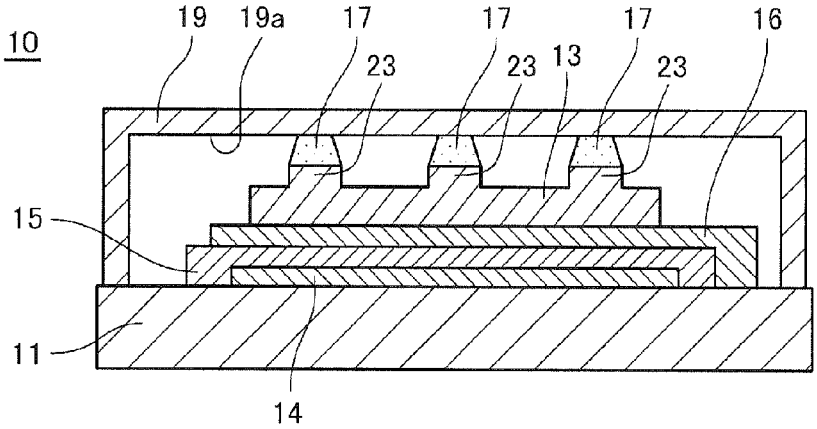
FIG. 10 is a cross-sectional view illustrating a protective element having a convex provided on a meltable conductor as a flux holding mechanism.

As illustrated in FIG. 10, a convex 23 may be formed on the surface of the meltable conductor 13 as a holding mechanism in the protective element 10. By providing the convex 23 in the protective element 10, the interval between the convex 23 and the top surface 19*a* of the covering member 19 is narrowed and a tension (capillary action) occurring in the interval between the convex 23 and the top surface 19*a* of the covering member 19 acts on the flux bodies 17 which can thus be held in place. The convex 23 is formed, for example, in a cylindrical shape and may be formed concurrently with forming the meltable conductor 13 by pressing, for example. One convex 23 is provided for each of the flux bodies 17, and a plurality of them are formed in positions corresponding to each of the above-mentioned plurality of flux bodies 17.

Furthermore, as the diameter of the flux bodies 17 are determined by the diameter of the convex 23, the convex 23 has a size according to the size of each of the flux bodies 17.

Figure 11:
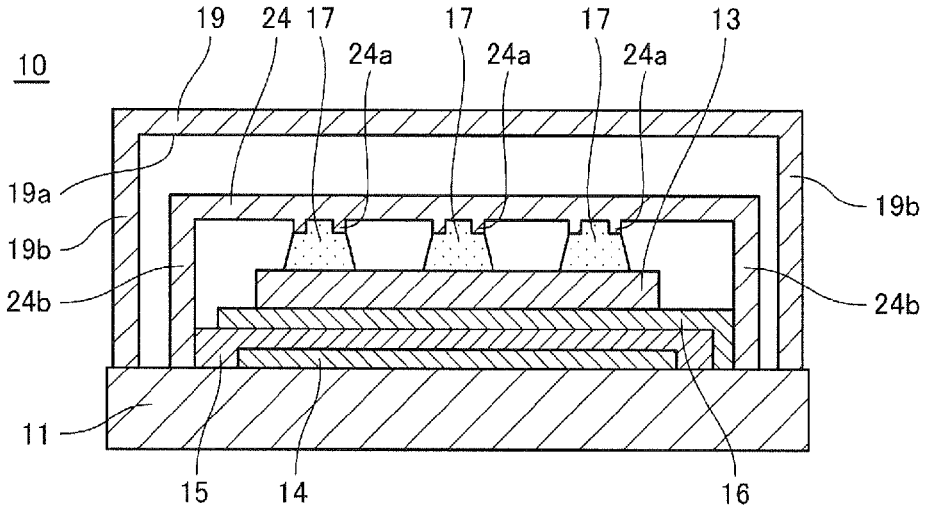
FIG. 11 is a cross-sectional view illustrating a protective element having a holding member on which a rib is formed as a flux holding mechanism.

As illustrated in FIG. 11, a holding member 24 for holding flux bodies 17 arranged on the insulating substrate 11 may be provided in the protective element 10 as a holding mechanism. The holding member 24 includes a rib 24*a* formed such as in the above-mentioned rib 21, and the flux bodies 17 are thus held between the rib 24*a* and the meltable conductor 13. By providing the holding member 24, the top surface 19*a* of the covering member 19 and the surface of the meltable conductor 13 are separated and, even in the case that the flux bodies 17 cannot be held by the rib 21, the height of the holding member 24 above the meltable conductor 13 can be freely selected and the flux bodies 17 can be reliably held at predetermined positions on the surface of the meltable conductor 13 by the rib 24*a*.

The holding member 24 is provided above the meltable conductor 13 by, for example, a side wall 24*b* being supported by the insulating substrate 11. It should be noted that the top surface 19*a* or a sidewall 19*b* of the covering member 19 may provide support for arranging the holding member 24 above the meltable conductor 13.

In this case, the holding hole 22 (not illustrated), as described above, may be provided on the meltable conductor 13 in a position opposing the rib 24*a*.

Figure 12:
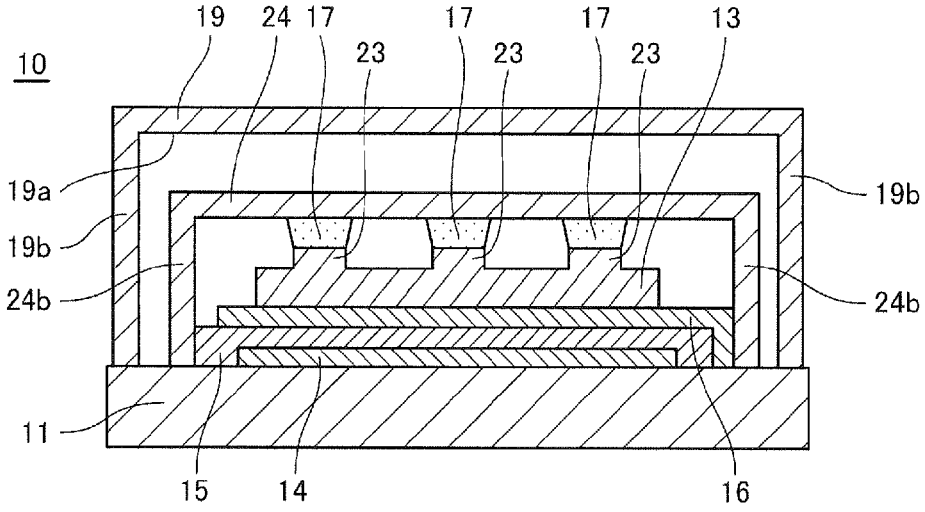
FIG. 12 is a cross-sectional view illustrating a protective element having a holding member and a meltable conductor on which a convex is formed as a flux holding mechanism.

As illustrated in FIG. 12, in the holding member 24, the flux bodies 17 may be held by providing the convex 23 described above on the meltable conductor 13 without providing the rib 24*a*. By providing the convex 23, the interval between the convex 23 and the holding member 24 is narrowed and a tension (capillary action), occurring in the interval between the convex 23 and the holding member 24, acts on the flux bodies 17 which can thus be held in place.

By providing the holding member 24, the top surface 19*a* of the covering member 19 and the convex 23 formed on the surface of the meltable conductor 13 are separated and, even in the case that the flux bodies 17 cannot be held, the height of the holding member 24 above the meltable conductor 13 can be freely selected and the flux bodies 17 can be reliably held at predetermined positions on the surface of the meltable conductor 13 by tensile forces occurring between the convex member 23 and the holding member 24.

Method of Using the Protective Element

Figure 13:
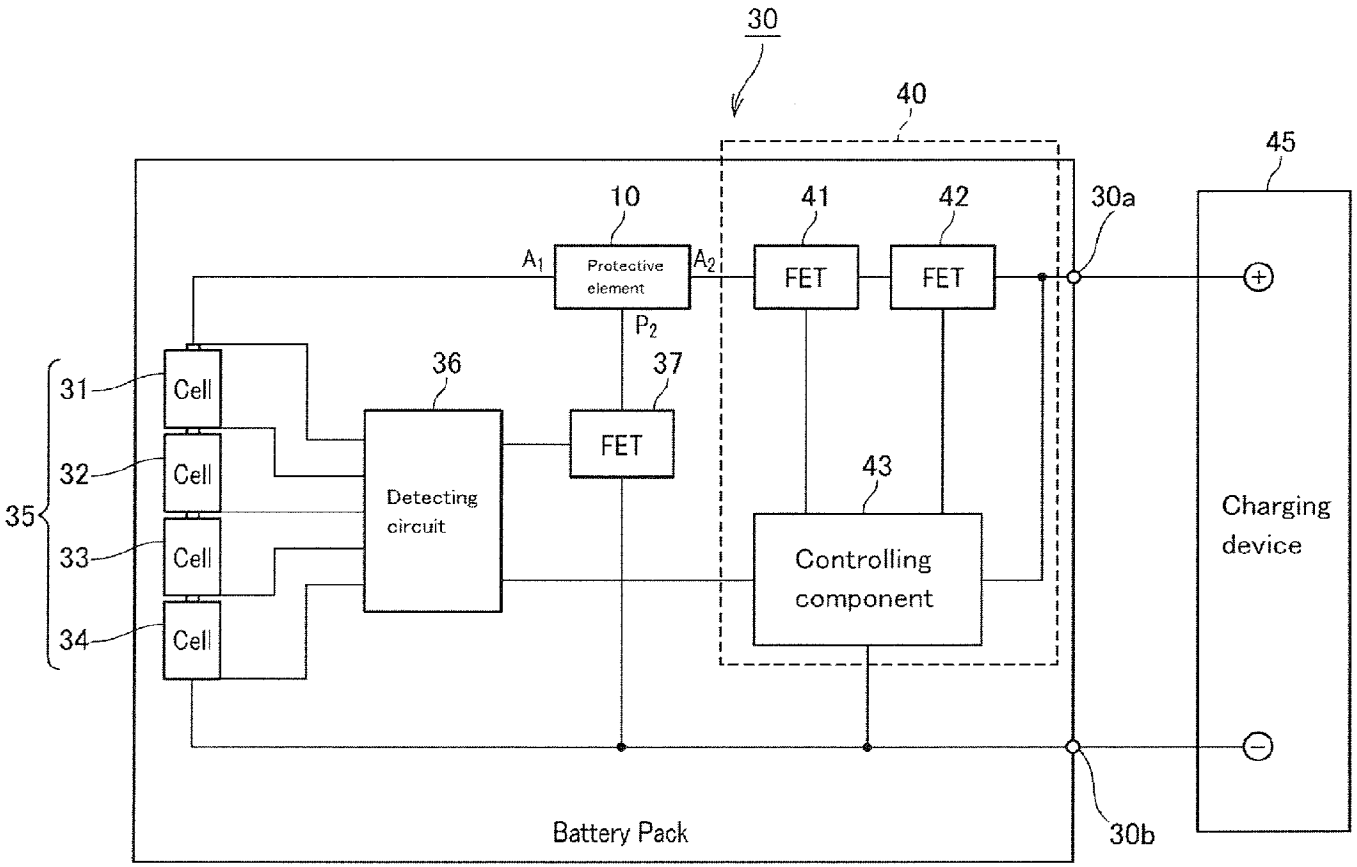
FIG. 13 is a circuit diagram illustrating a circuit configuration of a battery pack.

As illustrated in FIG. 13, such a protective element 10, can, for example, be used by incorporation into a circuit within a battery pack 30 of a lithium-ion secondary battery. The battery pack 30 includes, for example, a battery stack 35 comprising four battery cells 31 to 34 in a lithium ion secondary battery.

The battery pack 30 includes a battery stack 35, a charging/discharging controlling circuit 40 for controlling charging/discharging of the battery stack 35, a protective element 10 according to the present invention for interrupting electricity to the battery stack 35 in the event of an abnormality, a detecting circuit 36 for detecting voltage in each of the battery cells 31 to 34, and a current controlling element 37 for controlling operation of the protective element 10 in accordance with detection results of the detection circuit 36.

The battery stack 35, comprising battery cells 31 to 34 connected in series and requiring a control for protection from over-charging or over-discharging state, is removably connected to a charging device 45 via an anode terminal 30*a* and a cathode terminal 30*b* of the battery pack 30, and the charging device 45 applies charging voltage to the battery stack 35. The battery pack 30 charged by the charging device 45 can be connected to a battery-driven electronic appliance via the anode terminal 30*a* and the cathode terminal 30*b* and supply electric power to the electronic appliance.

The charging/discharging controlling circuit 40 includes the two current controlling elements 41, 42 connected to the current path from the battery stack 35 to the charging device 45 in series, and the controlling component 43 for controlling the operation of these current controlling elements 41, 42. The current controlling elements 41, 42 are formed of a field effect transistor (hereinafter referred to as FET) and the controlling component 43 controls the gate voltage to switch the current path of the battery stack 35 between conducting state and interrupted state. The controlling component 43 is powered by the charging device 45 and, in accordance with the detection signal from the detecting circuit 36, controls the operation of the current controlling elements 41, 42 to interrupt the current path when over-discharging or over-charging occurs in the battery stack 35.

The protective element 10 is connected in a charging/discharging current path between the battery stack 35 and the charging/discharging controlling circuit 40, for example, and the operation thereof is controlled by the current controlling element 37.

The detecting circuit 36 is connected to each battery cell 31 to 34 to detect voltage value of each battery cell 31 to 34 and supplies the detected voltage value to a controlling component 43 of the charging/discharging controlling circuit 40. Furthermore, when an over-changing voltage or over-discharging voltage is detected in one of the battery cells 31 to 34, the detecting circuit 36 outputs a control signal for controlling the current controlling elements 37.

When the detection signal output from the detection circuit 36 indicates a voltage exceeding the predetermined threshold value corresponding to over-discharging or over-charging of the battery cells 31 to 34, the current controlling element 37, which is formed of an FET, for example, controls protective element 10 to interrupt the charging/discharging current path of the battery stack 35 without the switching operation of the current controlling element 41, 42.

Figure 14:
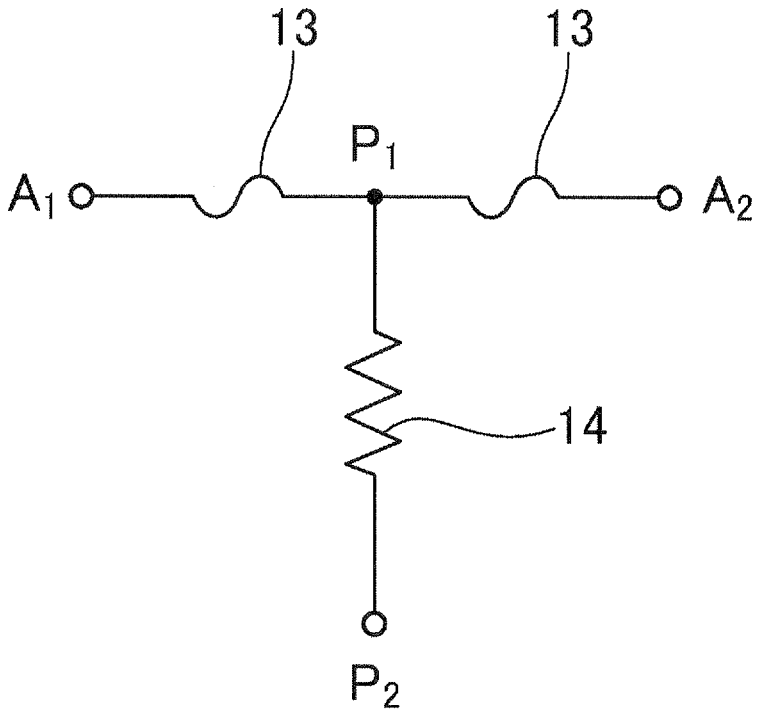
FIG. 14 illustrates an equivalent circuit of a protective element according to an embodiment of the present invention.
Figure 15A:
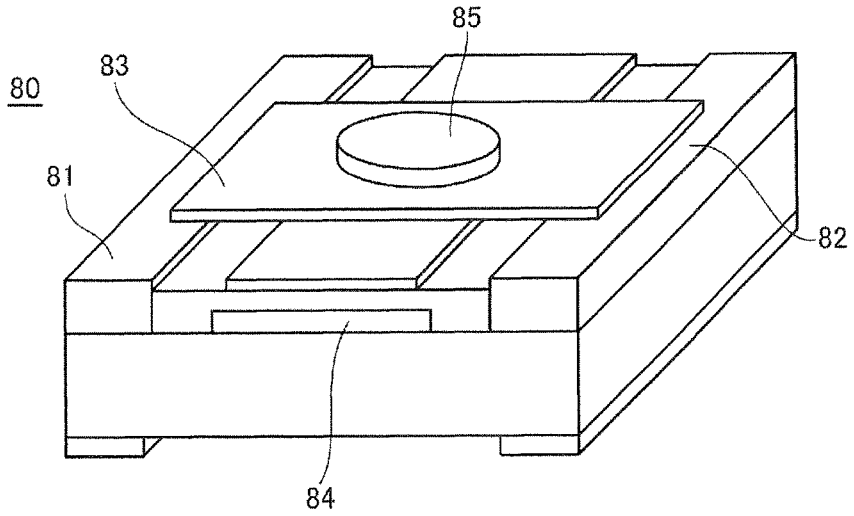
FIG. 15 (A) is a perspective view illustrating a conventional protective element and FIG. 15 (B) is a cross-sectional view thereof.
Figure 15B:
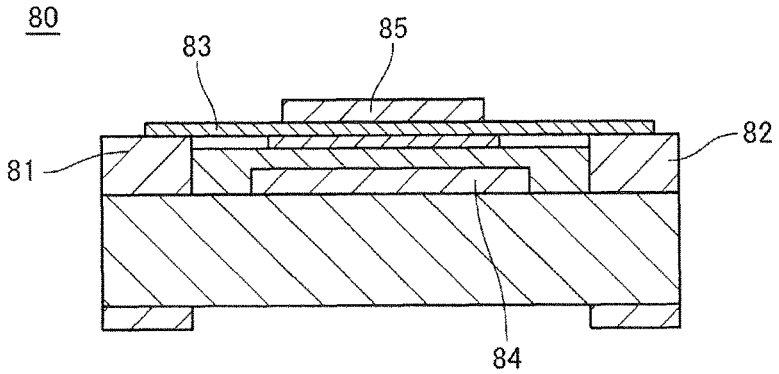
Figure 16:
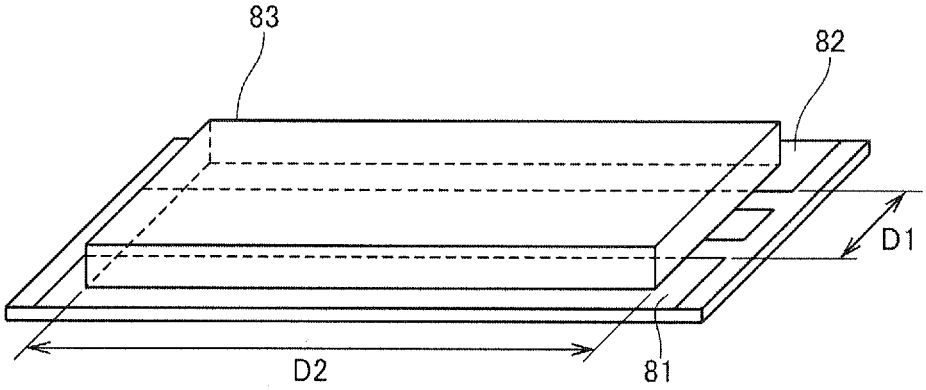
FIG. 16 is a perspective view illustrating a portion of a protective element using a rectangular meltable conductor.

FIG. 14 illustrates a circuit arrangement of the protective element 10 according to the present invention for such a battery pack 30 configured as described above. As illustrated, the protective element 10 includes a meltable conductor 13 connected in series via the heat-generating element extracting electrode 16 and a heat-generating resistor 14, through which a current flows via a connecting point to the meltable conductor 13, which generates heat to melt the meltable conductor 13. Furthermore, in the protective element 10, the meltable conductor 13 is directly connected in the charging/discharging current path and the heat-generating element 14 is directly connected to the current controlling element 37. The protective element 10 includes two electrodes 12, one being connected to A1 and the other being connected to A2. In addition, the heat-generating element extracting electrode 16 and the heat-generating element electrode 18 connected thereto connect to P1, and the other heat-generating element electrode 18 connects to P2.

In the protective element 10 having such a circuit configuration, the current path can be reliably interrupted by blowout of the meltable conductor 13 caused by heat generated by the heat-generating resistor 14.

Those skilled in the art will appreciate that the protective element according to the present invention is not limited to usage in battery packs of lithium ion secondary batteries but may be applied to any other application requiring interruption of a current path by an electric signal.

10 protective element, 11 insulating substrate, 12 electrodes, 13 meltable conductor, 13*a* melting portion, 14 heat-generating resistor, 15 insulating member, 16 heat-generating element extracting electrode, 18 heat-generating element electrode, 19 covering member, 21 rib, 22 holding hole, 23 convex, 24 holding member, 24*a* rib, 24*b* side wall, 30 battery pack, 31 to 34 battery cell, 36 detection circuit, 37 current controlling element, 40 charging/discharging controlling circuit, 41, 42 current controlling element, 43 controlling unit, 45 charging device

The invention claimed is:

1. A protective element comprising:

an insulating substrate;

a heat-generating resistor being rectangular and disposed on the insulating substrate;

a first electrode and a second electrode, the first and second electrodes being laminated onto the insulating substrate;

a heat-generating element extracting electrode overlapping the heat-generating resistor in a state electrically insulated therefrom and electrically connected to the heat-generating resistor on a current path between the first and the second electrodes;

a meltable conductor being rectangular and laminated between the heat-generating element extracting electrode and the first and the second electrodes for interrupting a current path between the first electrode and the second electrodes by being melted by heat, wherein the meltable conductor and the heat-generating resistor are superimposed and arranged such that a longitudinal direction of the meltable conductor and a longitudinal direction of the heat-generating resistor are in the same direction; and a plurality of flux bodies disposed along the heat-generating resistor and disposed above the meltable conductor, wherein above the meltable conductor is on a side of the meltable conductor opposite to a side of the meltable conductor on which the insulating substrate is disposed, the insulating substrate being disposed below the meltable conductor; and a plurality of ribs disposed along the heat-generating resistor, each of the plurality of flux bodies being held at a predetermined position by a rib of the plurality of ribs, so that the plurality of flux bodies are equal in size.

2. The protective element according to claim 1, wherein at least one of the plurality of flux bodies is disposed on a heat generation center of the heat-generating resistor.

3. The protective element according to claim 1, wherein the plurality of flux bodies are disposed along and above the heat-generating resistor.

4. The protective element according to claim 3, wherein each of the plurality of flux bodies covers a region extending from above the heat-generating resistor of the meltable conductor across a melting portion.

5. The protective element according to claim 1, wherein the plurality of flux bodies are disposed along a melting portion between the heat-generating element extracting electrode and the first and second electrodes.

6. The protective element according to claim 1, wherein the plurality of flux bodies are disposed above the heat-generating resistor, and along a melting portion between the heat-generating element extracting electrode and the first and second electrodes.

7. The protective element according to claim 1, wherein the plurality of flux bodies are disposed symmetrically about a heat generation center of the heat-generating resistor.

8. The protective element according to claim 1 further comprising:

a holding mechanism for holding each of the plurality of flux bodies at a predetermined position on the meltable conductor.

9. The protective element according to claim 8 further comprising:

a covering member for covering above the insulating substrate, the covering comprising the plurality of ribs;

wherein each of the plurality of flux bodies is held at the predetermined position by a corresponding rib of the plurality of ribs, which is provided on the covering member.

10. The protective element according to claim 8, wherein the meltable conductor has a holding hole provided therein for holding the plurality of flux bodies; and wherein each of the plurality of flux bodies is held at the predetermined position by the holding hole provided in the meltable conductor.

11. The protective element according to claim 8 further comprising:

a covering member for covering above the insulating substrate;

wherein a convex for holding the plurality of flux bodies is provided on the meltable conductor between the meltable conductor and the covering member; and wherein each of the plurality of flux bodies is held at a predetermined position by the convex provided on the meltable conductor.

12. The protective element according to claim 8 further comprising:

a flux holding member disposed on the insulating substrate, the flux holding member comprising the plurality of ribs;

wherein each of the plurality of flux bodies is held at the predetermined position by a corresponding rib of the plurality of ribs, which is provided on the covering member.

13. The protective element according to claim 8 further comprising:

a flux holding member disposed on the insulating substrate;

wherein a convex for holding the plurality of flux bodies is provided on the meltable conductor between the meltable conductor and the flux holding member; and wherein each of the plurality of flux bodies is held at a predetermined position between the convex provided on the meltable conductor and the flux holding member.

* * * * *